US005190407A

United States Patent [19]

Akesaka et al.

[11] Patent Number: 5,190,407

[45] Date of Patent: Mar. 2, 1993

[54] RECTANGULAR SHIELD EXCAVATING MACHINE

[75] Inventors: Toshio Akesaka, Kanagawa; Kazuto Hamada, Tokyo, both of Japan

[73] Assignees: Kabushiki Kaisha Iseki Kaihatsu Koki; Penta-Ocean Construction Co. Ltd., both of Tokyo, Japan

[21] Appl. No.: 817,286

[22] Filed: Jan. 6, 1992

[30] Foreign Application Priority Data

Jan. 14, 1991 [JP] Japan ..... 3-069534

[51] Int. Cl.[5] ..... E21D 9/08

[52] U.S. Cl. ..... 405/141; 405/138; 405/184; 299/69; 175/91

[58] Field of Search ..... 405/138, 141, 184; 175/91; 299/33, 69

[56] References Cited

U.S. PATENT DOCUMENTS

| | | | |
|---|---|---|---|
| 2,825,544 | 3/1958 | Ahlson | 175/91 |
| 2,950,902 | 8/1960 | Olds | 175/91 |
| 3,711,159 | 1/1973 | Mazzotti | 299/33 |
| 3,856,357 | 12/1974 | Wharton | 175/91 X |
| 4,045,088 | 8/1977 | Becham | 299/31 |
| 4,692,062 | 9/1987 | Akesaka | 405/141 |
| 4,886,396 | 12/1989 | Akesaka | 405/141 X |
| 5,102,201 | 4/1992 | Akesaka | 405/141 X |

FOREIGN PATENT DOCUMENTS

| | | | |
|---|---|---|---|
| 0384065 | 8/1990 | European Pat. Off. . | |
| 3424226 | 5/1986 | Fed. Rep. of Germany . | |
| 2095482 | 2/1972 | France . | |
| 2307950 | 11/1976 | France . | |
| 1-310089 | 12/1989 | Japan . | |
| 2-066295 | 3/1990 | Japan . | |
| 2-66295 | 6/1990 | Japan | 405/184 |
| 9000098 | 1/1990 | PCT Int'l Appl. . | |
| 968421 | 10/1982 | U.S.S.R. | 405/138 |
| 2150615 | 7/1985 | United Kingdom . | |

*Primary Examiner*—Randolph A. Reese
*Assistant Examiner*—Arlen L. Olsen
*Attorney, Agent, or Firm*—Webb, Burden, Ziesenheim & Webb

[57] ABSTRACT

A rectangular shield excavating machine comprises a quadrangularly tubular shield body having a space for receiving an excavated matter at the front end, a rotor disposed in the space so as to be capable of being rotated onward and backward angularly around an axis extending in the direction orthogonal to a pair of facing exterior portions of the body, and excavating means disposed in the body, drive means for rotating onward and backward the rotor angularly around the axis, and for driving the excavating means. Large gravels contained in the excavated matter are crushed by being put between the rotor and a member defining the space with the rotationally reciprocating motion of the rotor.

13 Claims, 13 Drawing Sheets

RECTANGULAR SHIELD EXCAVATING MACHINE

BACKGROUND OF THE INVENTION

1. Field of the Invention

This invention relates to a rectangular shield excavating machine for use in construction of a tunnel, a hole, a channel or the like having a quadrangular shape in section.

2. Description of the Prior Art

As one of rectangular shield excavating machines for excavating a tunnel having a quadrangular shape in section, there is disclosed a rectangular shield excavating machine using excavating means composed of a plurality of support rods disposed at an interval on a front portion of a quadrangularly tubular shield body so as to be capable of being linearly reciprocated in the direction orthogonal to an axis of the body and a plurality of cutter bits mounted on each support rod. (See Japanese Patent Public Disclosure (KOKAI) No. 1-310089)

In this excavating machine, the inside of the body is divided into a front area maintained at high pressure and a rear area maintained at atmospheric pressure through a partition wall, and the support rod is movably supported by a support plate disposed in the front area in parallel to the partition wall. This excavating machine excavates a facing by the linear reciprocating motion of each cutter bit with the linear reciprocating motion of the support rod.

As another rectangular shield excavating machine, there is disclosed a rectangular shield excavating machine using excavating means composed of a drum disposed on a front portion of a quadrangularly tubular shield body so as to be capable of being rotated around an axis extending in the direction crossing an axis of the body and a large number of cutter bits mounted on the outer peripheral surface of the drum. (See Japanese Patent Public Disclosure (KOKAI) No. 2-66295) This excavating machine excavates a facing by the rotary motion of each cutter bit with the rotary motion of the drum.

However, since neither of these excavating machines known per se can drain large gravels contained in an excavated matter, the ground containing the large gravels cannot be excavated by such excavating machines.

SUMMARY OF THE INVENTION

It is an object of the present invention to provide a rectangular shield excavating machine which can construct a tunnel, a hole, a channel or the like having a quadrangularly sectional shape in the ground containing large gravels.

A rectangular shield excavating machine according to the present invention comprises a quadrangularly tubular shield body having a space for receiving an excavated matter or cuttings at the front end, a rotor disposed in the space so as to be capable of being rotated onward and backward angularly around an axis extending in the direction orthogonal to a pair of facing exterior portions of the body, excavating means disposed in the body, and drive means for rotating onward and backward the rotor angularly around the axis and for driving the excavated means.

The excavating machine receives a thrust by a thrust generating device for advancing the excavating machine. While the excavating machine is advanced, the excavating means is driven by the drive means to excavate the facing. The excavated matter is received in the space formed in the body. The excavated matter within the space is shifted through the space toward the rear with the advance of the excavating device, and finally drained to the outside of the body by the draining means. During the excavation, the rotor is rotated onward and backward angularly around the axis by the drive means.

According to the present invention, since the large gravels are crushed by being put between the rotor and a member defining the space with the rotationally reciprocating motion of the rotor, a tunnel having a quadrangularly sectional shape can be constructed in the ground containing the large gravels.

It is preferable that the excavating machine further comprises means for draining the excavating matter in the space to the rear of the body.

It is preferable that the rotor is eccentric forward relative to the axis. Thus, since the rotor performs an eccentric motion during the excavation, the large gravels contained in the excavated matter can be surely crushed by being put between the rotor and the member defining the space.

The space can be formed into such a shape that the dimension in the direction orthogonal to the axis is gradually decreased from the front to the rear. In addition, the outer surface of the rotor can be formed into a polygonal shape in section.

It is preferable that the rotor has a plurality of projections on an outer surface portion shifted toward an inner surface portion of the member defining the space with the rotationally reciprocating motion of the rotor. Accordingly, the large gravels contained in the excavated matter are surely put between the rotor and the member defining the space with the rotationally reciprocating motion of the rotor.

If a plurality of projections are formed on the inner surface portion, the large gravels contained in the excavated matter are put between the rotor and the member defining the space more surely.

It is preferable that the excavating means is provided with a cutter head having an excavating portion extending in the direction of the axis and mounted on the rotor so as to perform a sectorially reciprocating motion around the axis with the reciprocating motion of the rotor.

Accordingly, since the excavated matter can be shifted surely through the space of the body to the rear with the advance of the excavating machine, a quantity of drainable excavated matter is large, and therefore, the efficiency of excavation is high. In addition, since the range of the reciprocating motion of the excavating portion can be widened, the ground containing the large gravels can be excavated surely.

The cutter head can be provided with an arm supported by the shaft and extending in the longitudinal direction, a support rod mounted on the front end of the arm and extending in the direction of the axis and a plurality of bits mounted on the support rod at spaced apart from each other in the direction of the axis.

The drive means can be provided with a shaft extending in the direction of the axis, disposed in the body rotatably around the axis and supporting the rotor and a drive mechanism for rotating onward and backward the shaft angularly around the axis.

It is preferable that the drive mechanism gives the power for rotating onward and backward the shaft angularly around the axis to both ends of the shaft. Accordingly, in comparison with a case of giving the power to one end of the shaft, the large power can be transmitted to the shaft by using a drive mechanism for generating the large power.

The space is divided into a muck chamber for receiving the excavated matter and a muddy water chamber for receiving the excavated matter from the muck chamber, and the excavated matter in the muddy water chamber can be drained by draining means of muddy water type. The muddy water is supplied to the muddy water chamber through a first pipe, and the excavated matter in the muddy water chamber is drained through a second pipe together with the muddy water.

Furthermore, it is preferable that the excavating machine further comprises means for detecting the range of the rotationally reciprocating motion of the excavating means. Thus, a quantity of outbreak by the excavating means can be regulated.

BRIEF DESCRIPTION OF THE DRAWINGS

The foregoing and other objects and features of the invention will become apparent from the following description of preferred embodiments of the invention with reference to the accompanying drawings, in which.

Figure 3:
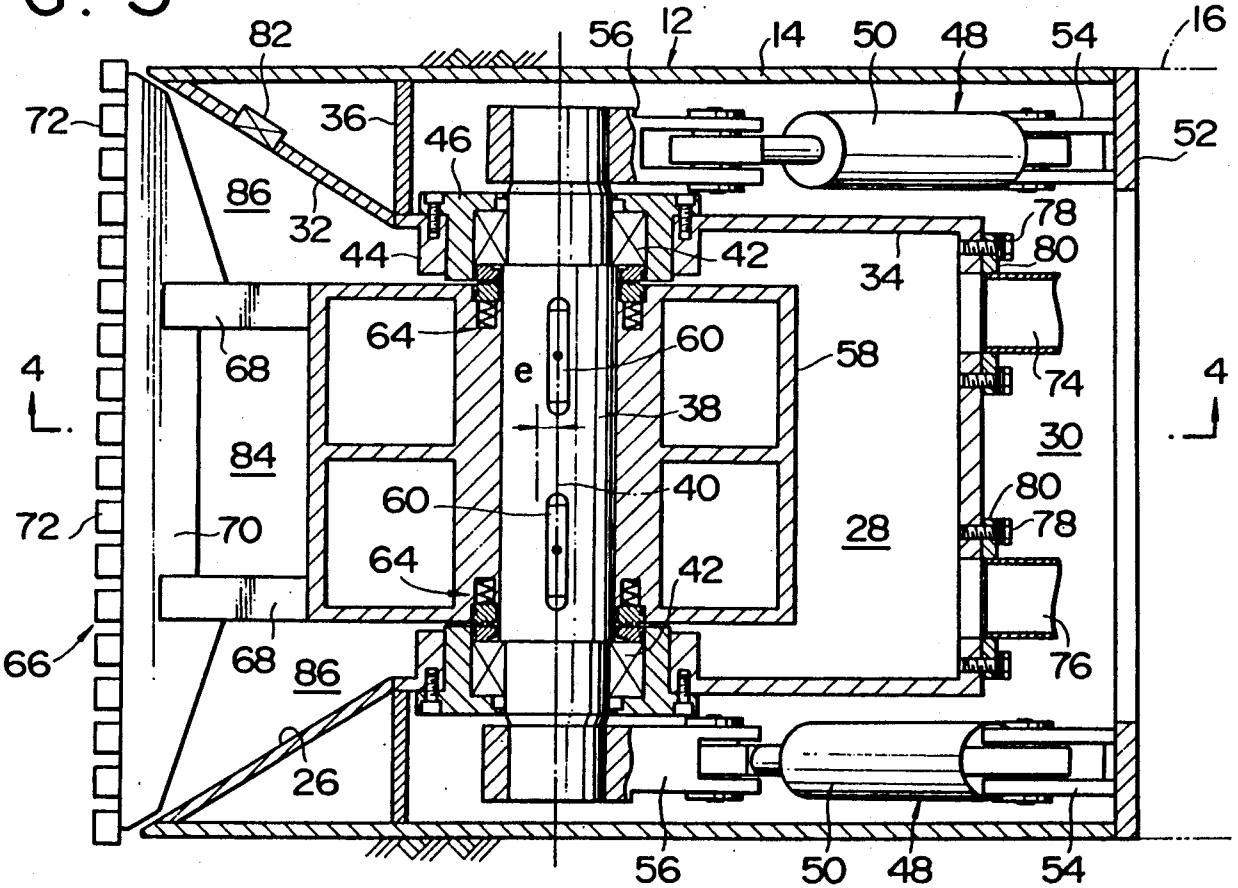
FIG. 3 is a sectional view taken along a line 3—3 in FIG. 2.
Figure 5:
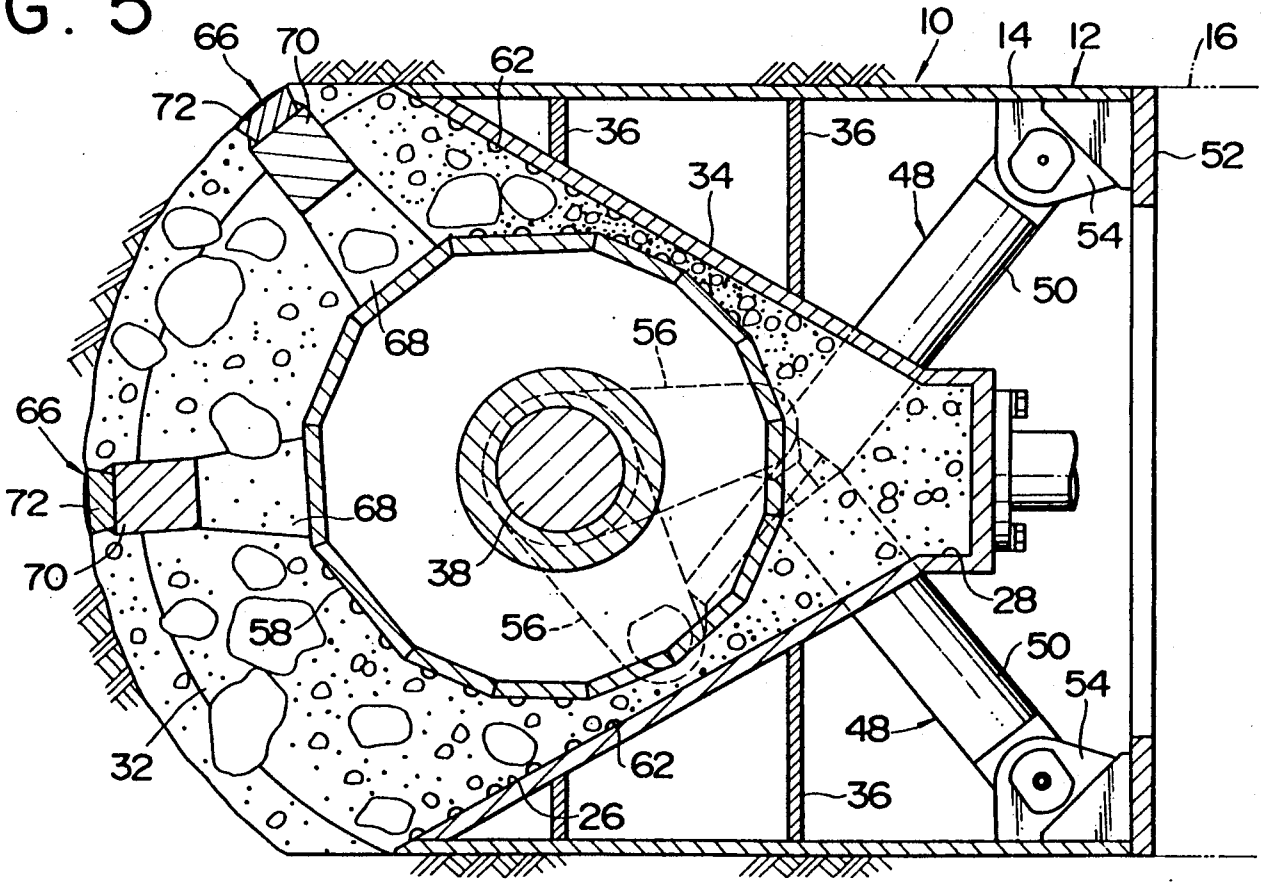
Figure 6:
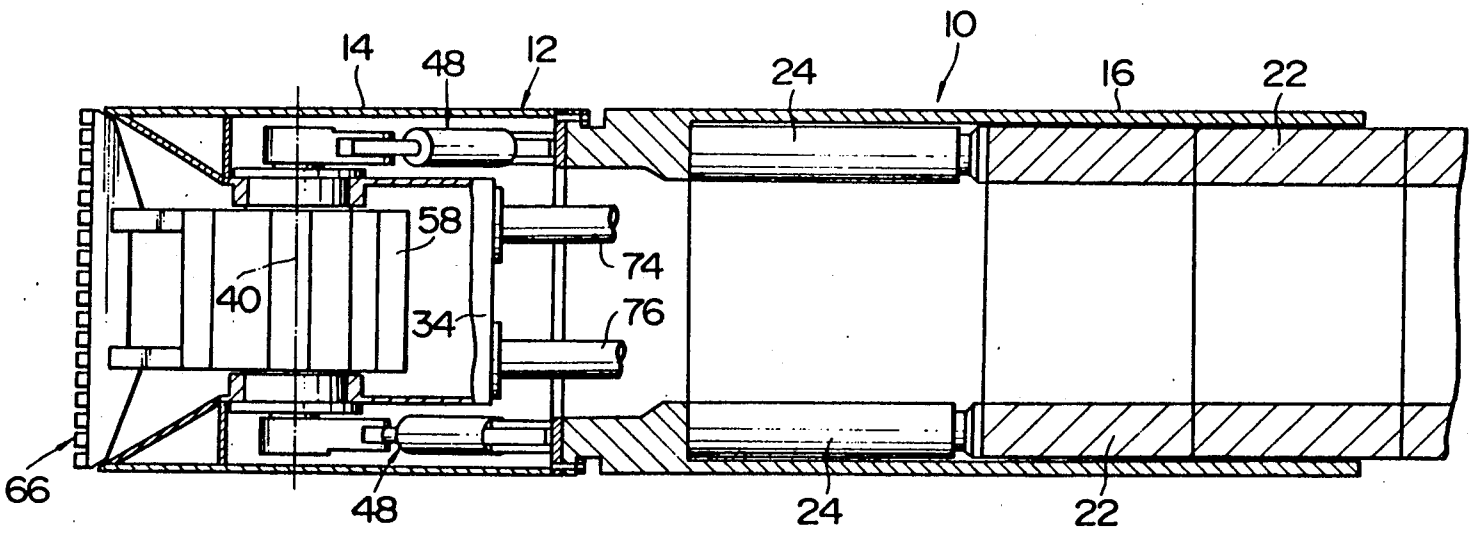
Figure 7:
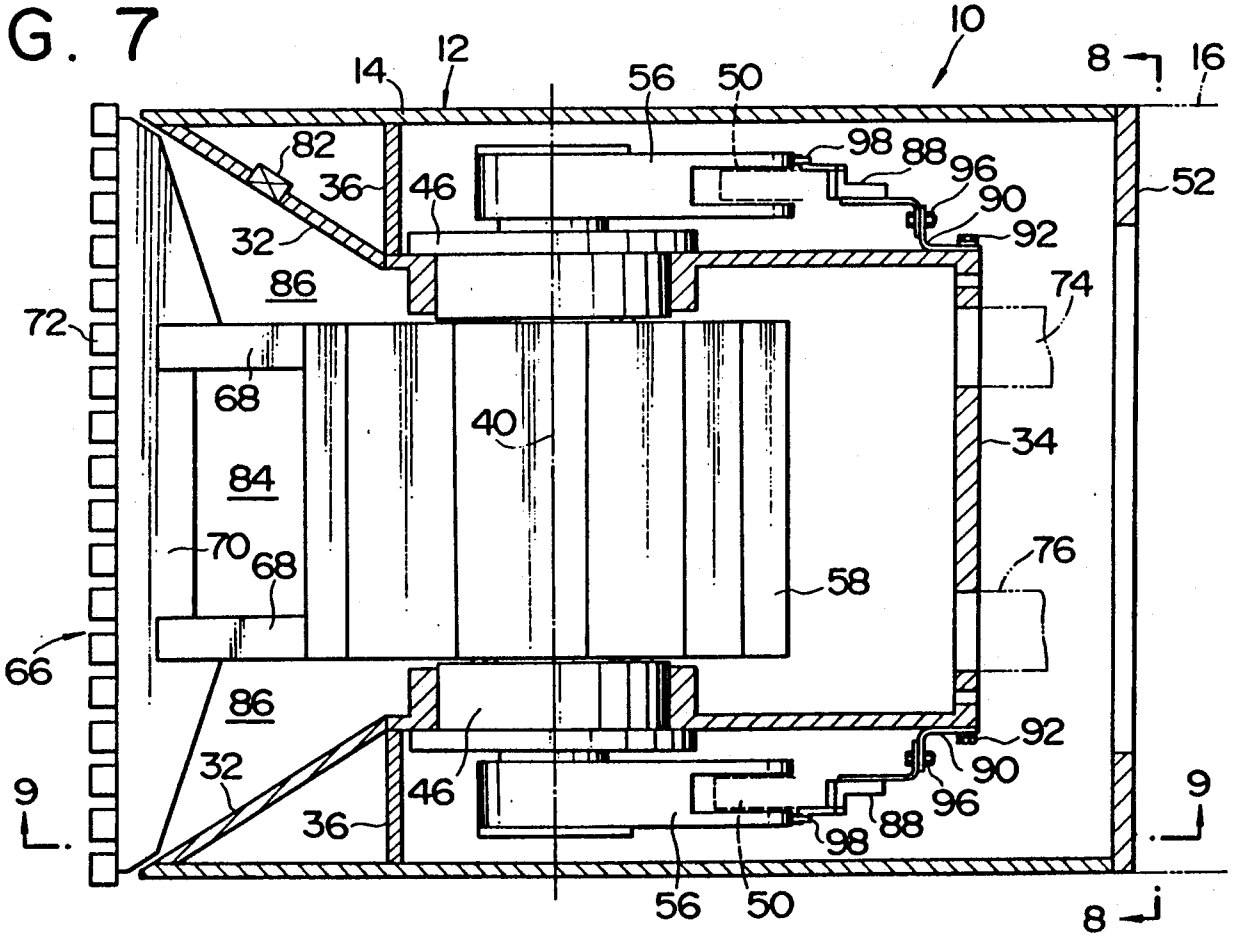
Figure 8:
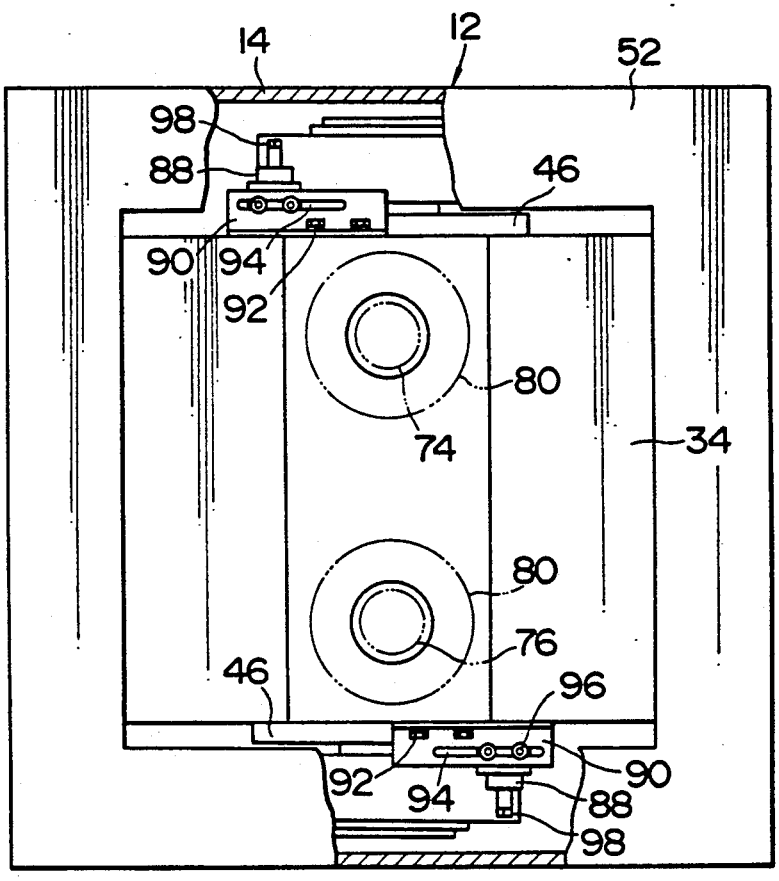
Figure 9:
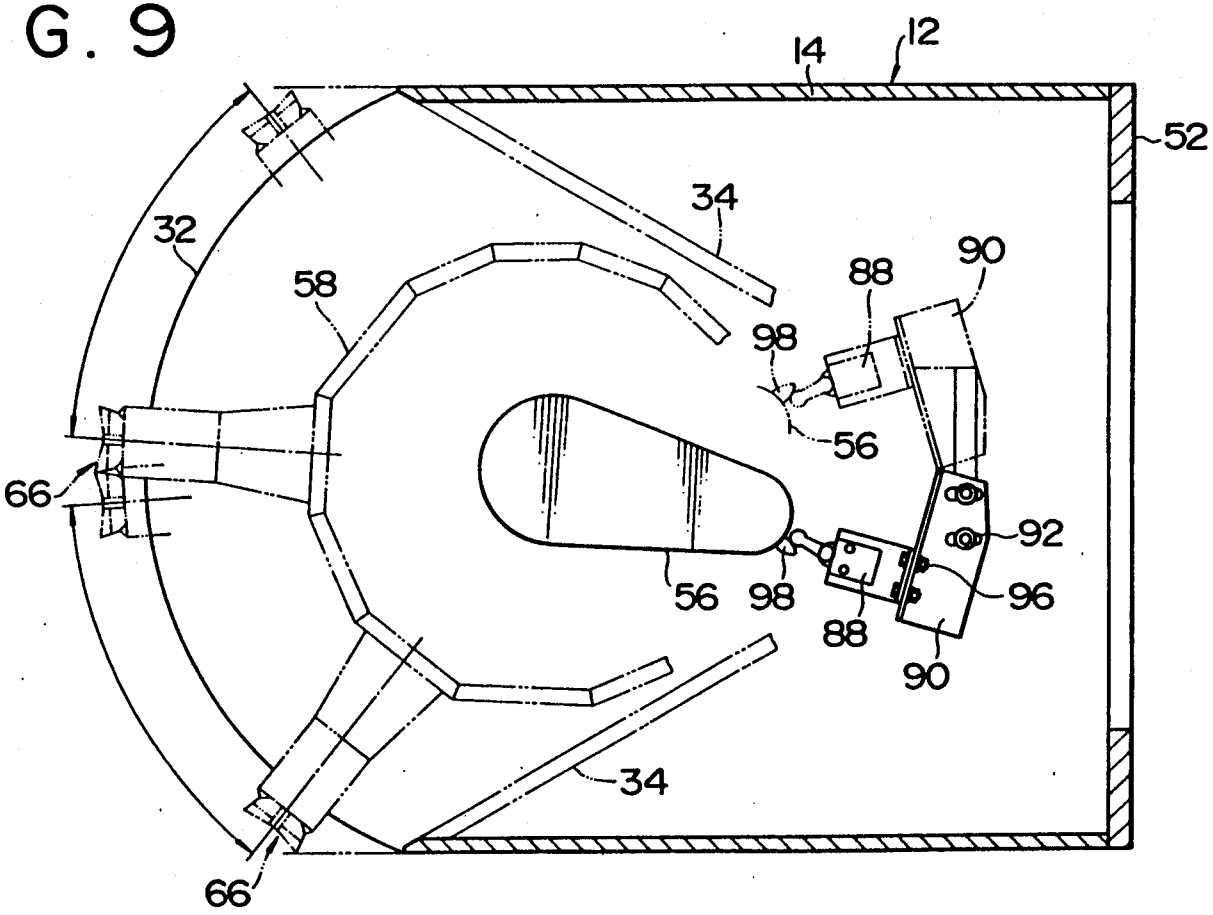
Figure 10:
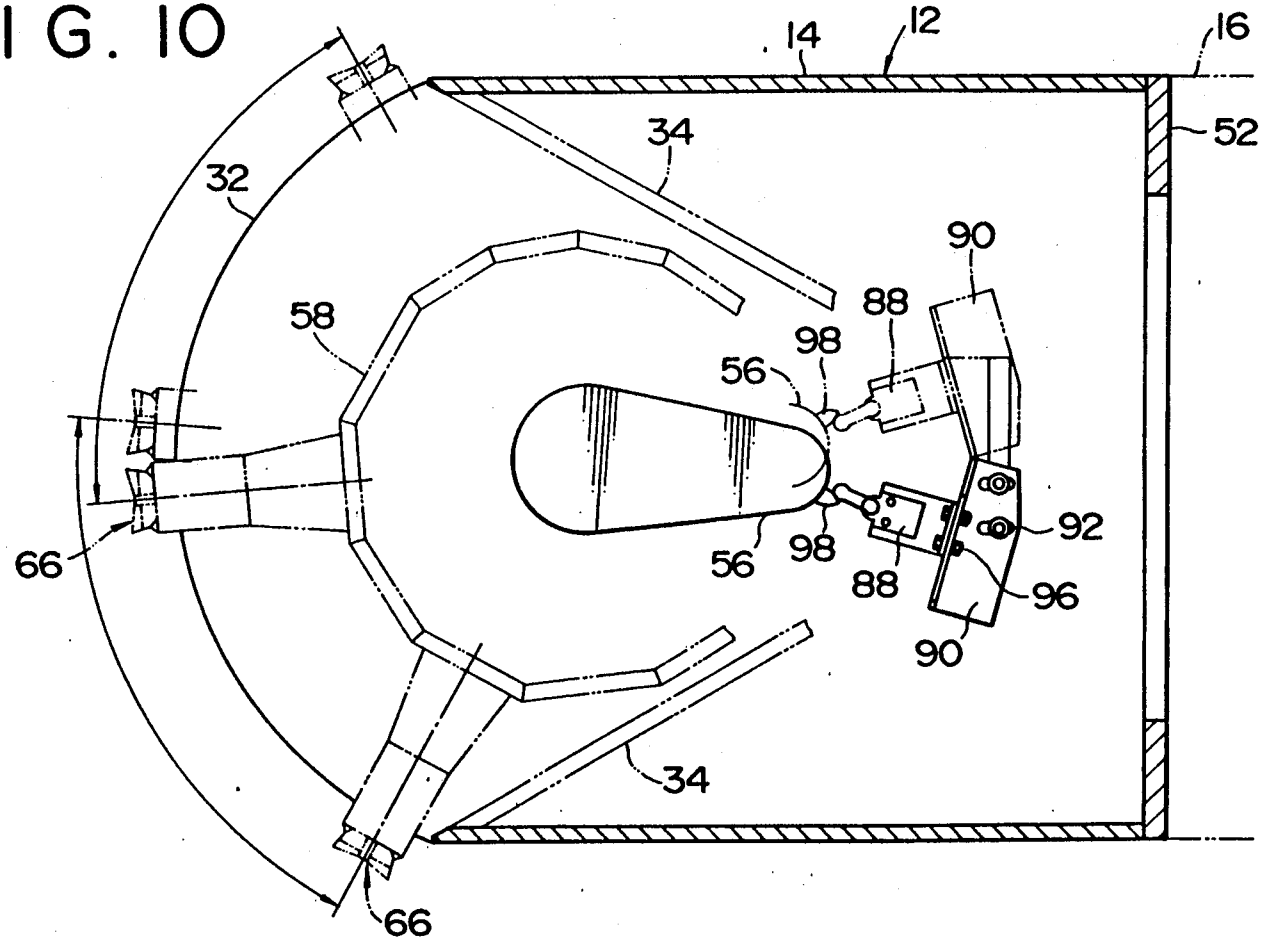
Figure 11:
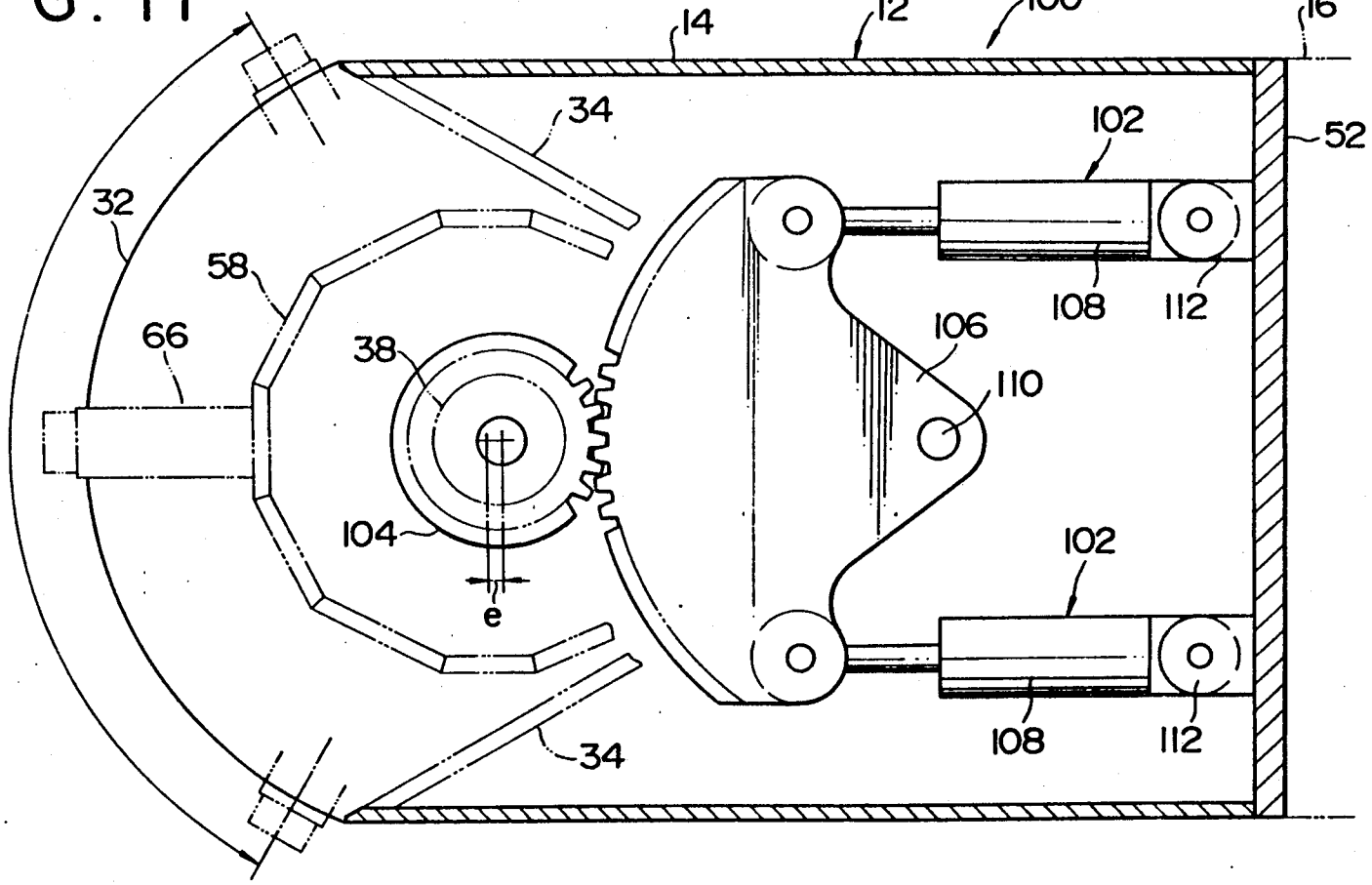
Figure 12:
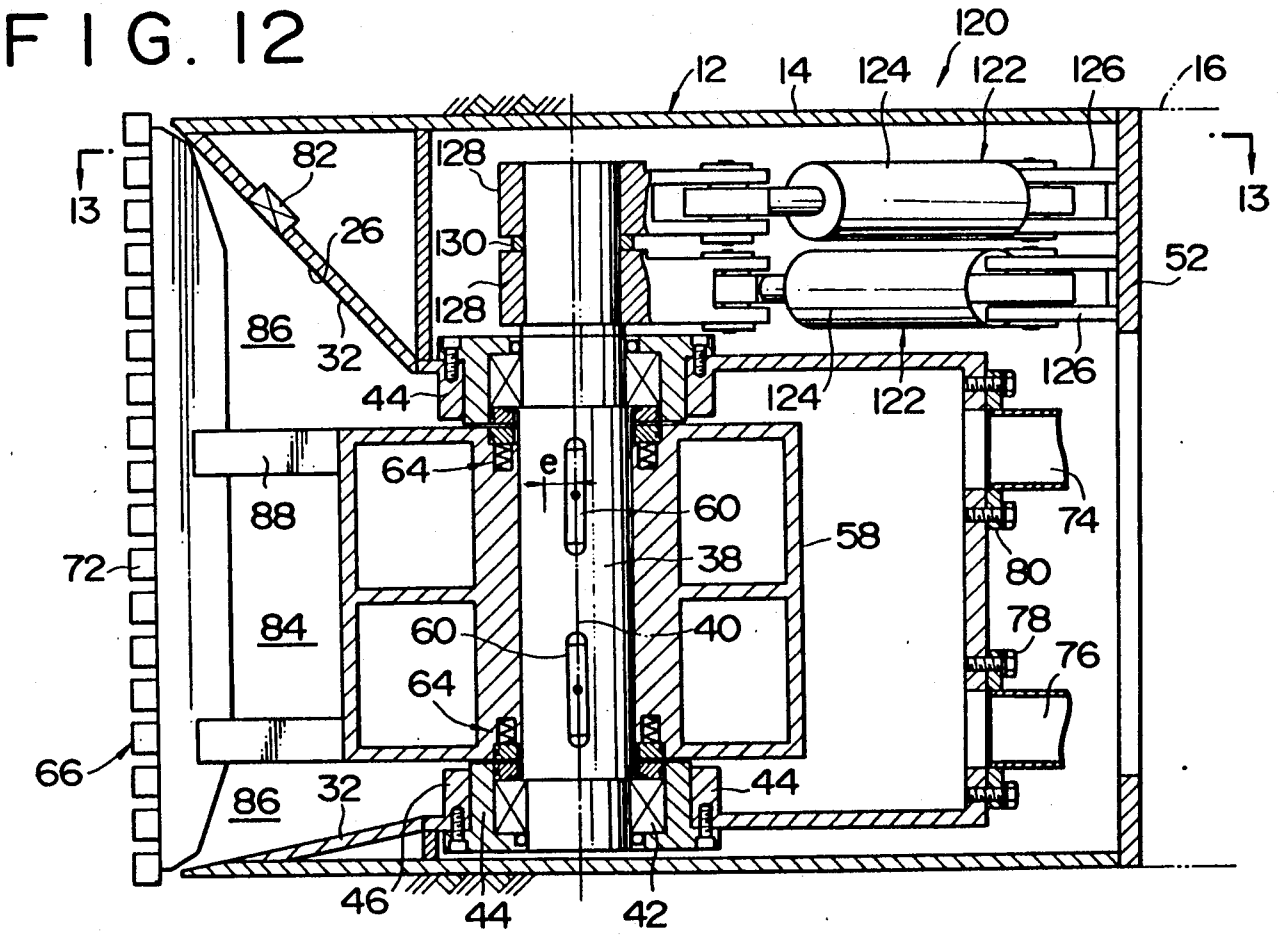
Figure 13:
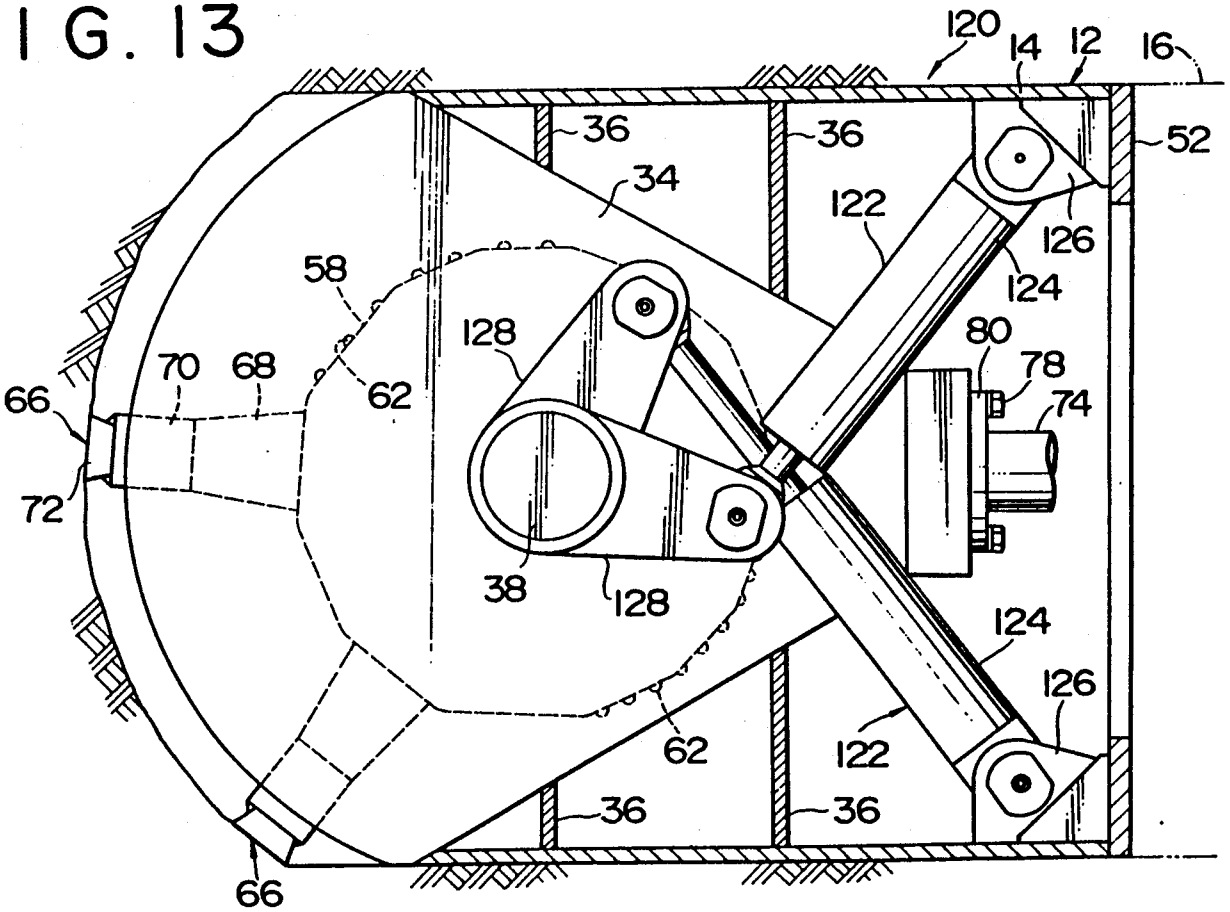

4 is a sectional view taken along a line 4—4 in FIG. 3;

FIG. 5 is a sectional view similar to that of FIG. 3, but showing an excavating condition;

FIG. 6 is a sectional view showing an excavating machine advanced by another thrust generating device;

FIG. 7 is a sectional view showing means for detecting an excavation range;

FIG. 8 is a view taken along a line 8—8 in FIG. 7;

FIG. 9 is a sectional view taken along a line 9—9 in FIG. 7;

FIG. 10 is a sectional view similar to that of FIG. 9, but showing an excavation range;

FIG. 11 is a sectional view showing an embodiment of an excavating machine using another drive mechanism;

FIG. 12 is a sectional view showing an embodiment of an excavating machine using a further drive mechanism; and FIG. 13 is a sectional view taken along a line 13—13 in FIG. 12.

DETAILED DESCRIPTION OF THE PREFERRED EMBODIMENTS

Referring now to FIGS. 1 through 5, a rectangular shield excavating machine 10 comprises a quadrangularly tubular shield body 12. The body 12 is provided with first and second quadrangularly tubular body portions 14, 16, which are abutted against each other and separably connected to each other through a plurality of bolts 18 shown in FIG. 1.

In the illustrated embodiment, the body 12 is advanced by receiving a thrust generated by a thrust generating device such as a basic thrusting device (not shown) through a plurality of quadrangular pipes 20 thrust into a place excavated by the excavating machine 10. As for the thrust generating device, however, use may be made of a device provided with a plurality of jacks 24 utilizing linings 22 constructed in the place excavated by the excavating machine 10 as a reactor, for example, as shown in FIG. 6.

The first body portion 14 has a muck chamber 26 for receiving an excavated matter, a muddy water chamber 28 connected to the rear of the muck chamber and an atmospheric pressure chamber 30 communicating with the inside of the second body portion 16. Both of the muck chamber 26 and the muddy water chamber 28 are partitioned from the atomospheric pressure chamber 30 through a plurality of wall members 32 mounted on the body 12 and defining a cutting edge and a case 34 connected to the wall members. The case 34 is supported by the first body portion 14 through a plurality of ribs 36.

The muck chamber 26 has such a quadrangular pyramid-like shape that the dimension in a first direction orthogonal to a pair of facing exterior portions of the body 12 and the dimension in a second direction orthogonal to the other pair of facing exterior portions of the body 12 are gradually decreased from the front to the rear. On the other hand, the muddy water chamber 28 has such a trapezoidal shape in section that the dimension in the above-mentioned first direction is gradually decreased from the front to the rear, while the dimension in the above-mentioned second direction is approximately the same.

A shaft 38 extending in the first direction is disposed at a boundary portion between the muck chamber 26 and the muddy water chamber 28. As shown in FIG. 3, both ends of the shaft 38 extend through the case 34. A bearing 42 for supporting the shaft 38 rotatably around an axis 40 of the shaft is disposed in a bearing case 46 mounted on a boss portion 44 of the case 34.

The shaft 38 is rotated onward and backward angularly around the axis 40 by a pair of drive mechanisms 48 connected to the ends of the shaft. In the illustrated embodiment, each drive mechanism 48 is provided with a double-acting jack 50 operated by pressure fluid such as compressed air, pressure water and operating hydraulic pressure, a bracket 54 for connecting a cylinder of the jack 50 to a rectangular end plate 52 mounted on the rear end of the first body portion 14 and a link 56 for connecting a piston rod of the jack 50 to the end of the shaft 38.

The bracket 54 is mounted. on the end plate 52 by bolts or the like, and the link 56 is mounted on the end of the shaft 38 by bolts or the like. Not only each bracket 54 and the jack 50 but also each link 56 and the jack 50 are pivotally connected to each other, respectively. Both links 56 are disposed at an angular interval around the axis of the shaft 38.

A rotor 58 is mounted on the shaft 38 such as to be incapable of displacement relative to each other by a plurality of keys 60. The rotor 58 has a polygonal (in the illustrated embodiment, a fourteen-gonal) outer surface, as shown in FIG. 5, and is eccentric relative to the axis 40 such that the center of the rotor 58 is positioned in front of the axis 40 by a distance e. A plurality of projections 62 are formed on the outer peripheral surface of the rotor 58 and the inner surface of the case 34 corresponding to the outer peripheral surface of the rotor.

As shown in FIG. 3, known mechanical seals 64 are disposed between both ends of the rotor 58 in the direction of the axis 40 and the bearing cases 46 corresponding to both ends of the rotor, respectively.

Two sets of cutter heads 66 are fixed to the rotor 58. Both cutter heads 66 are disposed at an interval angularly around the axis 40. Each cutter head 66 is provided with a pair of arms 68 extending forward from the outer surface portions of the rotor 58 spaced from each other in the direction of the axis 40, a support rod 70 for connecting the front ends of the arms to each other and a plurality of cutter bits 72 mounted at spaced apart each other in the direction of the axis 40 on the support rod 70 so as to define an excavating portion extending in parallel to the axis 40.

In the illustrated embodiment, the excavating machine 10 uses a draining device of muddy water type. This draining device is provided with a water supply pipe 74 for supplying muddy water to the muddy water chamber 28 and a drain pipe 76 for draining the muddy water in the muddy water chamber 88 together with the excavated matter. The pipes 74, 76 are connected to the case 34 by connectors 80 mounted on the case 34 by a plurality of bolts 78, respectively.

At the excavation time, both jacks 50 are operated such as to repeat the extension and the contraction under the condition that both jacks shift their phases by 180°. Namely, both jacks 50 repeat such a process shown in FIG. 4 that one jack 50 extends while at the same time, the other jack 50 contracts, and such a process shown in FIG. 5 that one jack 50 contracts while at the same time, the other jack 50 extends.

Accordingly, since the links 56 and the shaft 38 are rotated onward and backward angularly around the axis 40, the rotor 58 is rotated onward and backward angularly around the axis 40, so that the cutter heads 66 are sectorially swung around the axis 40. As a result, the cutter bits 72 are reciprocated along an arc around the axis 40 under the condition that the excavating portions, that is, the cutting portions of the cutter bits are pressed against a facing, and therefore, the facing is excavated by the cutting portions.

Figure 2:
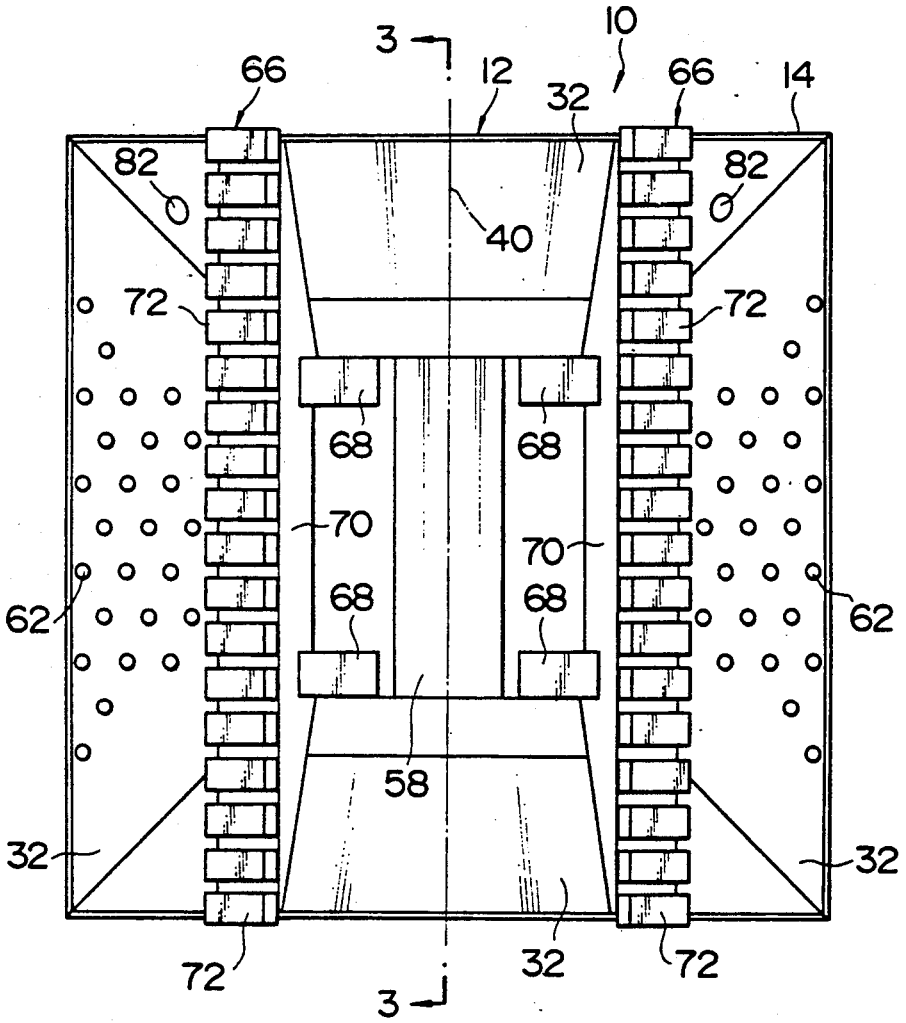
FIG. 2 is a enlarged view taken along a line 2—2 in FIG. 1.

During the excavation, a pressure of the muck chamber 26 is detected by a pressure sensor 82 shown in FIGS. 2 and 3, while it is maintained at such a predetermined pressure to prevent the facing from the collapse. The pressure in the muck chamber 26 can be adjusted by a pressure in the muddy water chamber 28 and an excavating speed or the like. The pressure in the muddy water chamber 28 can be adjusted by a quantity of muddy water to be supplied to the muddy water chamber and a quantity of muddy water to be drained from the muddy water chamber or the like. Therefore, the pressure of the muddy water chamber 28 is also preferably measured by a pressure gauge (not shown).

The excavated matter is received in the muck chamber 26, shifted through the muck chamber 26 toward the inner portion of the muck chamber, then shifted through the space between the rotor 58 and the case 34 to the muddy water chamber 28, and finally drained to the outside of the body 12 by the drain pipe 76. A shift of the excavated matter in the muck chamber 26 mainly depends on a fact that the excavating machine 10 advances while excavating the facing.

The muck received between the cutter heads 66 is shifted through the space 84 (See FIG. 3) between the arms 68 and the space 86 (See FIG. 3) between the arm 68 and the wall member 32 by the advance of the excavating machine 10 and the swing motion of the cutter heads 66.

In the excavating machine 10, the rotor 58 is rotated onward and backward angularly around the axis 40 under the condition that the center of the rotor 58 is positioned in front of the axis 40 by the distance e. Therefore, assuming that the direction of a short side in each of FIGS. 4 and 5 is defined as a vertical direction, when the rotor 58 is shifted from the condition shown in FIG. 5 to the condition shown in FIG. 4, the rotor 58 feeds the excavated matter within the muck chamber 26 into the muddy water chamber 28 at the lower portion in FIG. 4.

Figure 4:
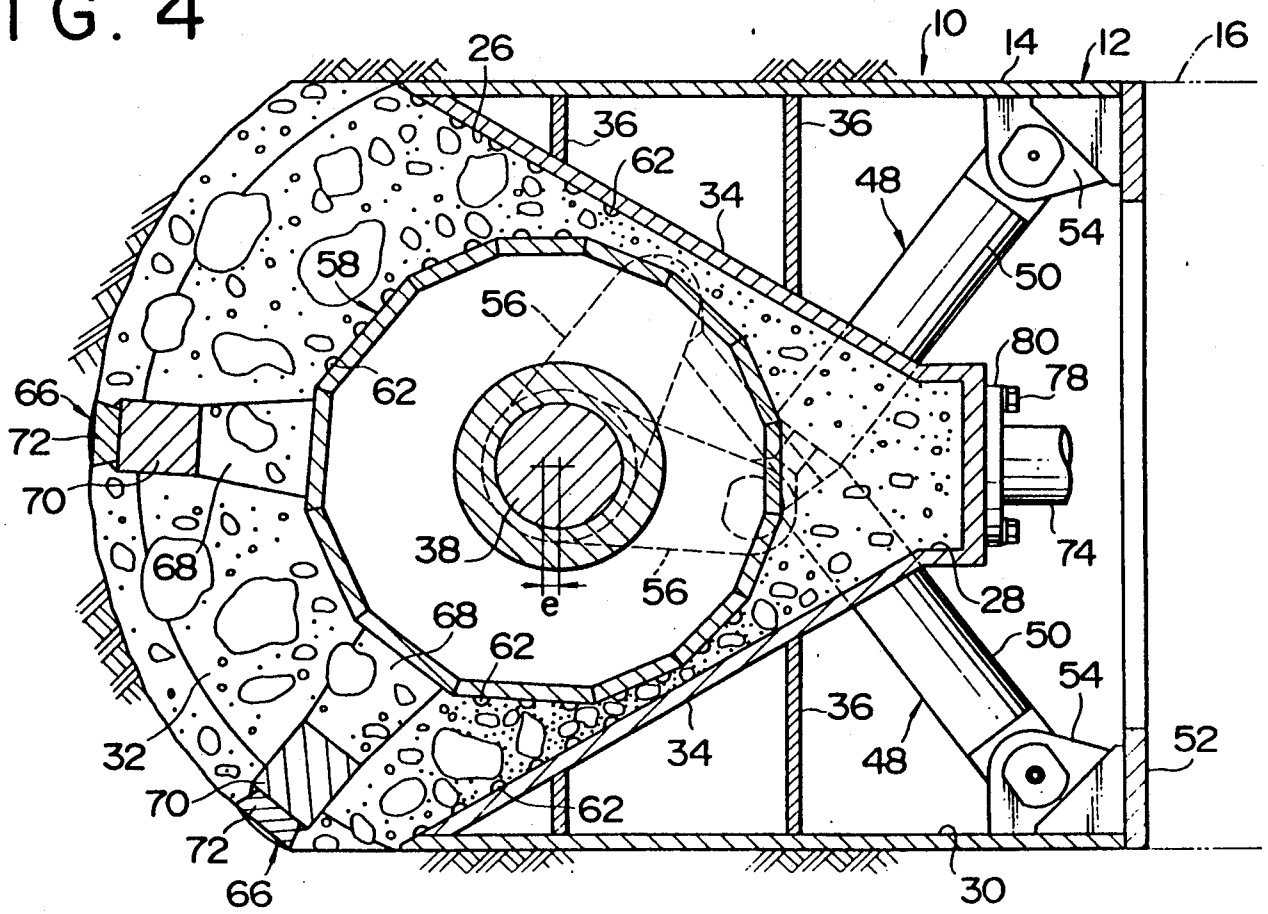

At that time, the upper portion of the rotor 58 in FIG. 4 is shifted so as to return the excavated matter within the muddy water chamber 28 to the muck chamber 26, while the upper portion of the rotor 58 is disposed so as to be largely apart from the case 34, so that the excavated matter within the muddy water chamber 28 can be prevented from returning to the muck chamber 26 at the upper portion of the rotor 58.

Similarly, when the rotor 58 is shifted from the condition shown in FIG. 4 to the condition shown in FIG. 5, the rotor 58 feeds the excavated matter within the muck chamber 26 into the muddy water chamber 28 at the upper portion in FIG. 5. At that time, since the lower portion of the rotor 58 is displaced so as to be largely apart from the case 34, the excavated matter within the muddy water chamber 28 can be prevented from returning to the muck chamber 26 at the lower portion of the rotor 58.

Large gravels contained in the excavated matter are crushed by being put between the outer surface of the rotor 58 and the inner surface of the case 34 with the eccentric motion of the rotor 58, as shown in FIGS. 4 and 5.

When the projections 62 provided on the rotor 58 are displaced so as to feed the excavated matter within the muck chamber 26 into the muddy water chamber 28, each projection 62 has a function of feeding the excavated matter within the muck chamber 26 into the muddy water chamber 28 and a function of putting the gravels between the rotor 58 and the case 34 in cooperation with the projections 62 provided on the rotor 58.

The excavation range in the direction of the swing motion of the cutter head 66 can be regulated by the range of the swing motion of the cutter head 66.

Therefore, as shown in FIGS. 7 through 10, the excavating machine 10 further comprises a pair of limit switches 88 disposed correspondingly to the links 56 so as to detect the range of the swing motion of the cutter head 66 and a bracket 90 for supporting the corresponding limit switch. Each bracket 90 is mounted on the case 34 by a plurality of bolts 92 and has a slot 94 extending in the direction of the swing motion of the link 56.

Each limit switch 88 is mounted on the bracket 90 by a fixture 96 composed of a bolt extending through the slot 94 and a nut screwed onto the bolt so as to be changeable the position in the direction of the swing motion of the link 56. Each link 56 has a projection 98 for opening and closing the corresponding limit switch 88 in response to the swing motion of the link.

At the excavation time, when the jack 50 is extended and contracted, the link 56 is sectorially swung around the axis 40, and therefore, each limit switch 88 generates an electric signal every time the projection 98 of the corresponding link 56 comes into contact with an actuator. This electric signal is utilized as a timing signal for changing over the extension and the contraction of the jack 50.

The range of the swing motion of the cutter head 66 is small when each limit switch 88 is disposed at a position shown in FIG. 9, whereas it is large when each limit switch 88 is disposed at a position shown in FIG. 10. Therefore, the range of the swing motion of the cutter head 66 and the outbreak can be varied by varying the mounting position of the limit switch 88 relative to the bracket 90. The range of he swing motion of the cutter head 66 is shown by an arc-like arrow in FIGS. 9 and 10.

The power for rotating the shaft 38 may be transmitted to one end of the shaft 38. As illustrated embodiment, however, if the power for rotating the shaft 38 is transmitted to both ends of the shaft 38, large power can be transmitted by using a jack for generating a large drive force, in comparison with a case of transmitting the power to one end of the shaft.

Instead of providing a plurality of cutter heads 66 like the above-mentioned excavating machine 10, one cutter head 66 may be provided like an excavating machine 100 shown in FIG. 11. In addition, as for the drive mechanism for giving the swing motion to the cutter head 66, other drive mechanism may be used.

A drive mechanism 102 used in the excavating machine 100 shown in FIG. 11 is provided with a gear 104 mounted on the end of the shaft 38, a sector wheel 106 meshing with the gear 104 and a pair of double-acting jacks 108 for giving the rotationally reciprocating motion to the wheel 106. The wheel 106 is pivotally supported to the first body portion 14 by a pin 110. A cylinder of each jack 108 is pivotally connected to the end plate 52 by a bracket 112, and a piston rod is pivotally connected to one end of the wheel 106.

At the excavation time, both jacks 108 are operated so as to repeat the extension and the contraction under the condition that both jacks shift their phases by 180°. Accordingly, since the wheel 106 is swung around the pin 110, the gear 104 is rotated onward and backward angularly around the axis of the gear. As a result, the shaft 38 and the rotor 58 are rotated onward and backward angularly around the axis of the shaft 38, and therefore, the cutter head 66 is swung around the axis of the shaft 38.

In an excavating machine 120 shown in FIGS. 12 and 13, two drive mechanism 122 disposed at an interval in the axial direction of the shaft 38 are connected to one end of the shaft 38.

Figure 1:
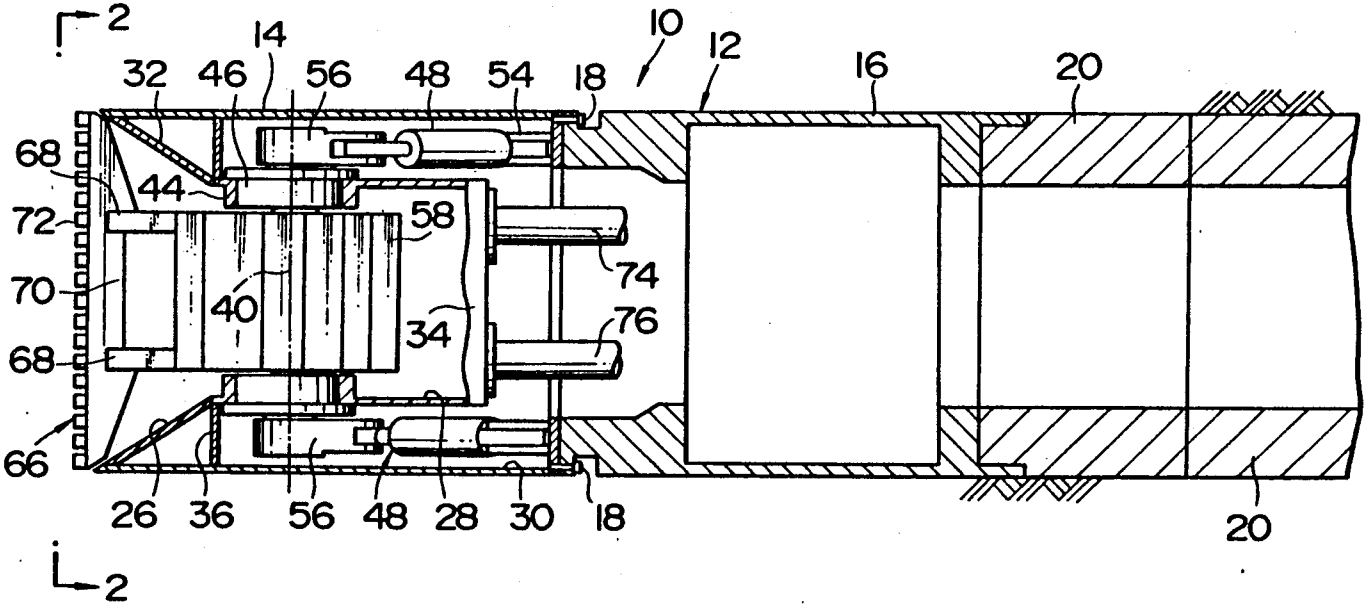
FIG. 1 is a sectional view showing an embodiment of a rectangular shield excavating machine according to the present invention.

Similar to the drive mechanism 48 shown in FIG. 1, each drive mechanism 122 is provided with a double-acting jack 124 operated by pressure fluid, a bracket 126 for connecting a cylinder of the jack 124 to the end plate 52 and a link 128 for connecting a piston rod of the jack 124 to the end of the shaft 38.

Both links 128 are disposed at an angular interval around the axis of the shaft 38. A collar 130 is disposed between both links 128. Both jacks 124 are operated by shifting their phases by 180°.

Furthermore, instead of constructing a tunnel, a hole or a channel by using one excavating machine 10, 100 or 120, a larger tunnel may be constructed by using a plurality of matrix-like arranged excavating machine 10, 100 or 120 and making such a plurality of excavating machines perform an excavation simultaneously.

Instead of the draining device of muddy water type, use may be made of other draining device such as a screw conveyer. In addition, a part of the excavated matter in the muck chamber or the whole excavated matter may be drained to the periphery of the body, particularly to the side of the excavating machine by the angularly reciprocating and rotary motion of the rotor or the like.

As for the excavating means, instead of the above-mentioned cutter head 66, use may be made of means provided with a drum disposed at the front portion of the quadrangularly tubular shield body rotatably around an axis extending in the direction crossing the axis of the body and a large number of cutter bits mounted on the outer peripheral surface of the drum.

What is claimed is:

1. A rectangular shield excavating machine, comprising:

a quadrangularly tubular shield body having a front end, a rear end and a pair of facing exterior members, said body defining a space in said front end for receiving cuttings;

a rotor disposed in said space having an onward and backward angular rotation around an axis extending a direction parallel to said facing exterior members;

excavating means disposed in the front end of said body; and drive means for rotating onward and backward said rotor angularly around said axis;

wherein said space includes a muck chamber for receiving said cuttings, said muck chamber shaped so that its dimension in a direction orthogonal to said axis is gradually decreased from the front end toward the rear end;

wherein at least one of said facing exterior members and said rotor include means for crushing large gravels contained in the cuttings and for feeding the cuttings further into said muck chamber toward the rear end of the body.

2. A rectangular shield excavating machine according to claim 1, further comprising means for draining the cuttings in said space to the rear end of said body.

3. A rectangular shield excavating machine according to claim 2, wherein said space includes a muddy water chamber for receiving the cuttings from said muck chamber, and said draining means is provided with a first pipe for supplying muddy water to said muddy water chamber and a second pipe for draining the cuttings in said muddy water chamber together with the muddy water.

4. A rectangular shield excavating machine according to claim 3, wherein said drive means is provided with a shaft extending in the direction of said axis, disposed in said body rotatably around said axis and supporting said rotor and a drive mechanism for rotationally reciprocating said shaft angularly around said axis.

5. A rectangular shield excavating machine according to claim 4, wherein said drive mechanism gives the power for rotationally reciprocating said shaft angularly around said axis to both ends of said shaft.

6. A rectangular shield excavating machine according to claim 1, wherein the outer surface of said rotor has a polygonal shape in section.

7. A rectangular shield excavating machine according to claim 1, wherein said means for crushing and for feeding includes a plurality of projections on an outer surface portion, said projections shifted toward an inner surface of at least one of the facing exterior members defining said space with the rotationally reciprocating motion of said rotor, said projections engaging gravel in said muck chamber to crush the gravel and feed it further into said muck chamber toward the rear end of said body.

8. A rectangular shield excavating machine according to claim 7, including a plurality of projections on said inner surface of said facing exterior member.

9. A rectangular shield excavating machine according to claim 1, wherein said excavating means is provided with a cutter head having an excavating portion extending in the direction of said axis, and mounted on said rotor such as to perform the sectorial reciprocating motion around said axis with the rotationally reciprocating motion of said rotor.

10. A rectangular shield excavating machine according to claim 9, wherein said cutter head is provided with an arm supported by said rotor and extending in the longitudinal direction, a support rod mounted on the front end of said arm and extending in the direction of said axis and a plurality of bits mounted on said support rod at intervals in the direction of said axis.

11. A rectangular shield excavating machine according to claim 1, further comprising means for detecting the range of the reciprocating motion of said excavating means.

12. A rectangular shield excavating machine according to claim 1, wherein said rotor is eccentric forward relative to said axis.

13. A rectangular shield excavating machine, comprising:

a quadrangularly tubular shield body having a front end, a rear end and a pair of facing exterior members, said body defining a space in said front end for receiving cuttings;

a rotor disposed in said space to be capable of being rotated onward and backward angularly around an axis extending in a direction parallel to said facing exterior members, said rotor being eccentrically forward relative to said axis;

excavating means disposed in the front end of said body; and drive means for rotating onward and backward said rotor angularly around said axis;

wherein said space includes a muck chamber for receiving said cuttings, said muck chamber shaped so that its dimension in a direction orthogonal to said axis is gradually decreased from the front end toward the rear end;

whereby at least one of said facing exterior members cooperates with said rotor to crush large gravels contained in the cuttings and feed the cuttings further into said muck chamber toward the rear end of the body.

* * * * *

UNITED STATES PATENT AND TRADEMARK OFFICE

CERTIFICATE OF CORRECTION

PATENT NO. : 5,190,407

DATED : March 2, 1993

INVENTOR(S) : Toshio Akesaka and Kazuto Hamada

It is certified that error appears in the above-indentified patent and that said Letters Patent is hereby corrected as shown below:

Column 2 Line 62 "at" should read --and--.

Column 3 Line 32 "a enlarged" should read --an enlarged--.

Column 3 Line 36 before "4" insert --FIG.--.

Column 5 Lines 10-11 delete "spaced apart each other" and insert --intervals--.

Column 5 Line 19 "88" should read --28--.

Column 7 Line 8 "he swing" should read --the swing--.

Column 7 Line 12 after "As" insert --an--.

Column 7 Line 23 "mechanism" should read --mechanisms--.

Column 7 Line 45 "mechanism" should read --mechanisms--.

Claim 1 Lines 19-20 Column 8 after "extending" insert --in--.

Signed and Sealed this

Twenty-first Day of June, 1994

*Attest:*

Bruce Lehman

BRUCE LEHMAN

*Attesting Officer*

*Commissioner of Patents and Trademarks*